US005326155A

United States Patent [19]

Wild

[11] Patent Number: 5,326,155

[45] Date of Patent: Jul. 5, 1994

[54] BACK REST FOR A CHAIR

[75] Inventor: Konrad Wild, Engelthal, Fed. Rep. of Germany

[73] Assignee: Friedrich W. Dauphin GmbH & Co. Entwicklungs- und Beteiligungs-KG, Neukirchen, Fed. Rep. of Germany

[21] Appl. No.: 834,944

[22] Filed: Feb. 14, 1992

[30] Foreign Application Priority Data

Mar. 8, 1991 [DE] Fed. Rep. of Germany ..... 4107451

[51] Int. Cl.[5] ..... A47C 7/14

[52] U.S. Cl. ..... 297/452.38; 297/440.21

[58] Field of Search ..... 297/440, 444, 452, 452.38, 297/440.21

[56] References Cited

U.S. PATENT DOCUMENTS

| | | | |
|---|---|---|---|
| 3,037,814 | 6/1962 | Gardner et al. | 297/444 |
| 3,295,891 | 1/1967 | Brown | 297/452 |
| 3,656,593 | 4/1972 | Bauer . | |
| 3,711,054 | 1/1973 | Bauer . | |
| 4,023,860 | 5/1977 | Harder, Jr. | 297/444 |
| 4,390,210 | 6/1983 | Wisniewski et al. | 297/444 |
| 4,662,680 | 5/1987 | Dauphin . | |
| 4,966,412 | 10/1990 | Dauphin . | |
| 5,080,310 | 1/1992 | Choi | 248/221.3 |
| 5,110,186 | 5/1992 | Clark et al. | 297/444 |

FOREIGN PATENT DOCUMENTS

| | | | |
|---|---|---|---|
| 470361 | 11/1973 | Australia . | |
| 0021726 | 1/1981 | European Pat. Off. . | |
| 0125598 | 11/1984 | European Pat. Off. . | |
| 0394441 | 10/1990 | European Pat. Off. . | |
| 3402852 | 9/1985 | Fed. Rep. of Germany | 297/440 |
| 2060367 | 5/1981 | United Kingdom | 297/444 |

*Primary Examiner*—Peter M. Cuomo
*Assistant Examiner*—Darnell M. Boucher
*Attorney, Agent, or Firm*—Browdy and Neimark

[57] ABSTRACT

A back rest for a chair, namely in particular an office chair, has a base plate and a concealing shell disposed at the rear side of the base plate. The concealing shell conceals with its rims the base plate in the region of its edges. In order to ensure an easy assembly and dismantling of the concealing shell to the base plate, hook connections are formed between the base plate and the concealing shell, which can be closed or released by displacing the base plate and the concealing shell in relation to and substantially parallel to each other.

14 Claims, 5 Drawing Sheets

BACK REST FOR A CHAIR

FIELD OF THE INVENTION

The invention relates to a back rest for a chair, in particular an office chair, comprising a base plate having a rear side and edges and a concealing shell having rims, the concealing shell being disposed at the rear side of the base plate, and concealing with its rims the base plate in an area of said edges.

BACKGROUND OF THE INVENTION

With known back rests of the generic type the concealing shell is provided with arrowhead-like locking pins thus having barbed-like heads, while receiving sleeves which are correspondingly undercut are provided for the locking pins at the rear side of the base plate. The manufacture is relatively complicated, as the locking pins on the one hand and the receiving sleeves on the other hand cannot be manufactured of a cheap plastics material, but have to be glued, if for the base plate and the concealing shell themselves relatively simple plastics materials are used respectively. Furthermore, the assembly of the concealing shell to the base plate is in fact relatively simple, even if a high amount of force is necessary; a releasing, however, is very difficult to accomplish and most often results in breaking off at least one part of the locking pin, so that a renewed assembly cannot reliably be carried out.

SUMMARY OF THE INVENTION

It is an object of the invention to embody a back rest of the generic type such that an assembly and a dismantling respectively can be accomplished very easily, whereby a manufacture in one piece of the base plate on the one hand and of the concealing shell on the other hand should be possible.

This object is attained in accordance with the invention by hook connections being formed between the base plate and the concealing shell, which hook connections can be locked or released by displacing the base plate and the concealing shell in relation to each other and in a direction of displacement substantially parallel to each other. The base plate and the concealing shell are interconnected by pushing one into the other and, if necessary, by locking the hook connections. They are principally released from each other in the reverse direction. A particularly reliable retaining is attained if at least two hook connections are provided, disposed at a distance of each other in a direction of displacement. It is particularly advantageous, if at least one part of the rims of the concealing shell is integrated in the interlocking system as elastic members.

Numerous features, details and advantages of the invention will become apparent from the ensuing description of one example of embodiment taken in conjunction with the drawing.

DESCRIPTION OF THE PREFERRED EMBODIMENTS

Figure 1:
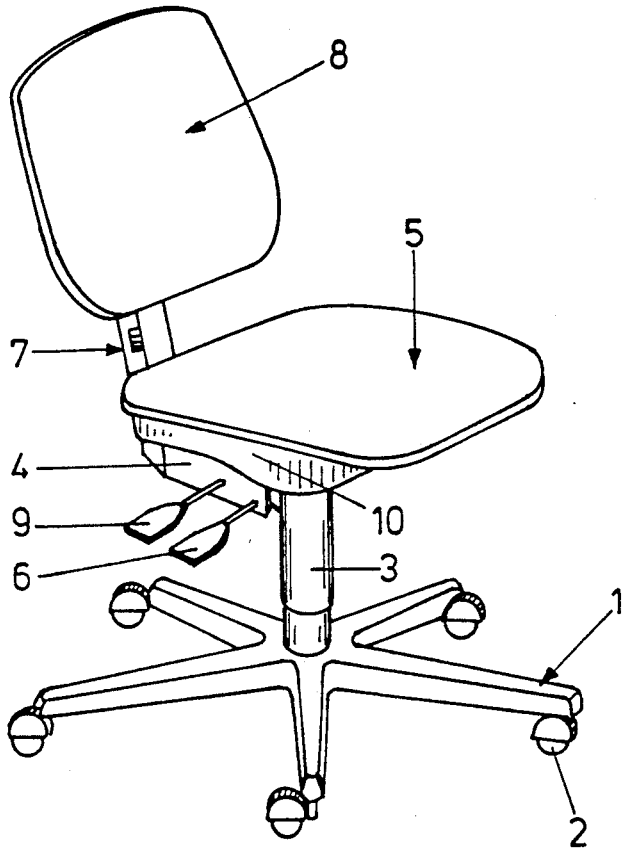
FIG. 1 shows an office chair with a back rest.

FIG. 1 shows an office chair which has a pedestal 1, which is supported on the floor by means of casters 2. At the pedestal 1 a chair column 3 which is adjustable in height is disposed, to the upper end of which a seat support 4 is secured, on which in turn a seat 5 is disposed. The height of the chair column 3 is adjusted by means of an operating lever 6 which is fixed in the seat support 4. Furthermore at the seat carrier 4 a back rest support 7 is fixed, which carries a back rest 8. A further operating lever 9 is fixed at the seat support 4 for the purpose of changing the tilt of the back rest support 7 with the back rest 8 while, if necessary, simultaneously changing the tilt of the seat 5. The described basic design of the office chair is generally known. The chair column 3 adjustable in height is known for instance from U.S. Pat. No. 3,711,054. The design of the seat support 4 including the described pivoting possibilities of back rest 8 and seat 5 is known for instance from U.S. Pat. No. 4,966,412. The seat support 4 can be partially optically concealed by a casing 10 secured to the lower side of the seat 5.

As best shown in FIGS. 2–5, the back rest 8 has an inner base plate 11, which is covered with a padding 12 on its front side facing the user. On its rear side 13 facing away from the user it is provided with a concealing shell 14, which is described in detail below.

Figure 2:
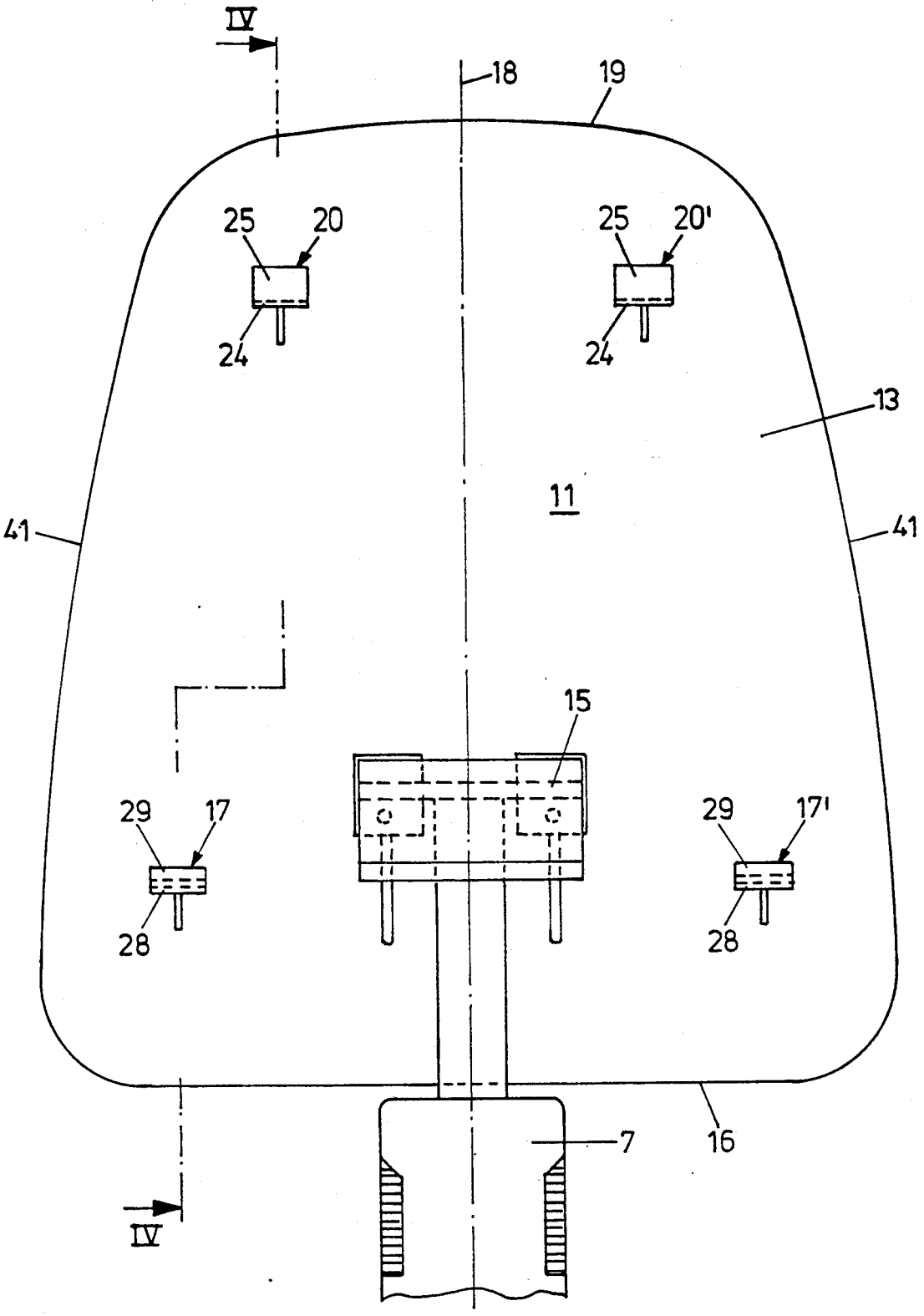
FIG. 2 shows a plan view of the rear side of a base plate of the back rest.
Figure 7:
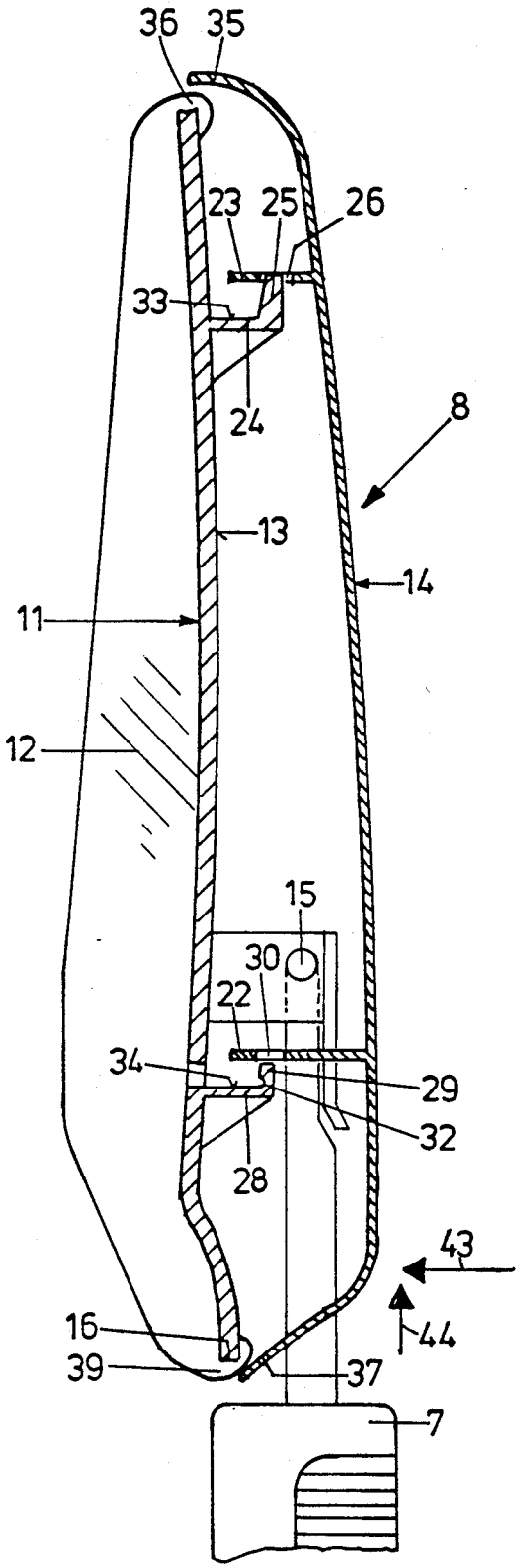

The back rest support 7 is secured to the rear side 13 of the base plate 11 by means of a horizontal pivot hinge 15, so that—in predetermined limitations—the back rest 8 can be pivoted in relation to the back rest support 7. As shown in FIG. 2, adjacent to the lower edge 16 of the base plate 11 a locking hook 17, 17' is disposed on both sides of the pivot hinge 15 respectively. The two hooks 17, 17' are disposed mirror symmetrical to the vertical central longitudinal plane of symmetry 18 of the back rest 8. As best shown in FIGS. 2 and 7, adjacent to the upper edge 19 of the base plate 11 and also symmetrically to the plane of symmetry 18 retaining hooks 20, 20' are disposed at the rear side 13 of the base plate 11. The hooks 17, 17', 20, 20' are formed in one piece with the base plate 11 which is injection-molded of plastics material.

As shown in FIGS. 4–7, on its inner side 21 the concealing shell 14 which is also injection-molded of plastics material has plate-like abutments 22, 22' and 23, 23' which are formed in one piece with the concealing shell 14, and which abutments are associated to the hooks 17, 17', 20, 20'.

An abutment 22, 22' each is associated to the locking hooks 17, 17', whereas the abutments 23, 23', which are rigidly formed to prevent distortion in direction to the edges 16, 19, are associated to the retaining hooks 20, 20'.

The retaining hooks 20, 20' adjacent to the upper edge 19 have a flexural resistant stand 24 disposed at the base plate 11, at the upper side of which stand 24 a plate-like projection 25 is provided which is oriented towards the upper edge 19 and which is approximately rectangularly angled. A receiver opening 26 adapted in cross-section is associated to this projection 25 in the abutment 23 or 23'. The projection 25 has a guide surface 27 on its side facing the rear side 13 of the base plate 11, which is tilted from the free end 28 of the projection 25 such that it approaches the rear side 13 and that it has the smallest distance to the rear side 13 at the transition to the stand 24.

Figure 6:
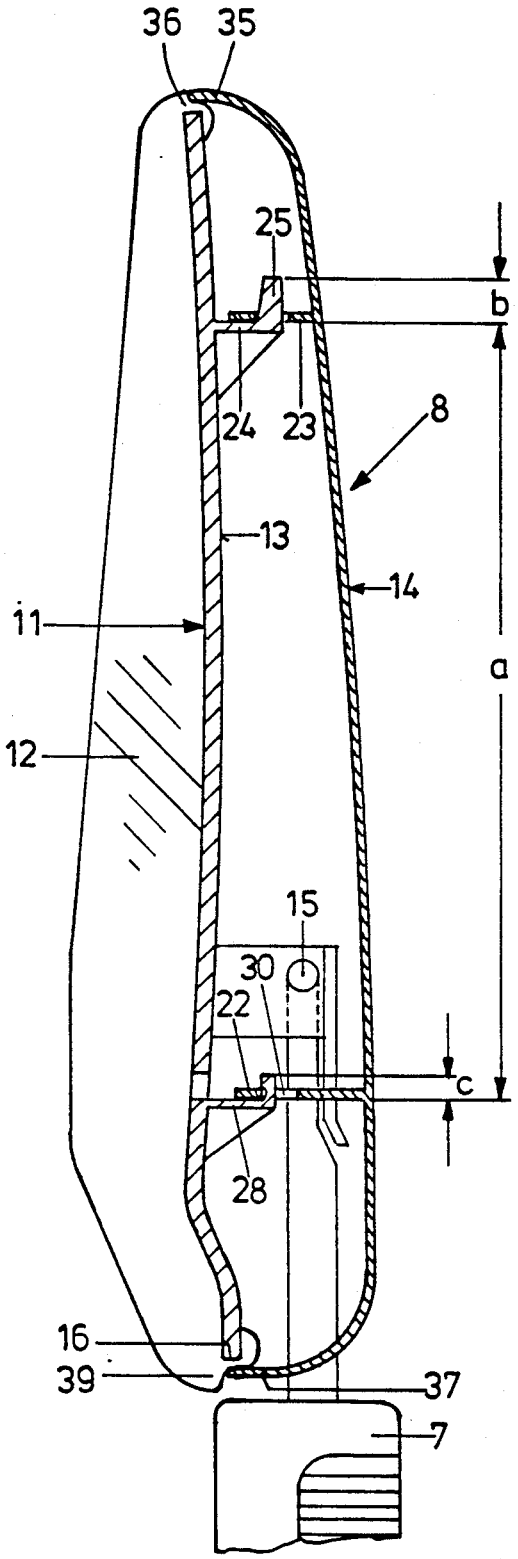
FIG. 6 shows a section through the back rest according to the illustration in FIGS. 4 and 5 at the end of the assembly and FIG. 7 shows a section through the back rest according to the illustration in FIGS. 4 to 6 during the dismantling of the concealing shell from the base plate.

The locking hooks 17, 17' each have also a flexural resistant stand 28, at which end facing away from the rear side 13 of the base plate 11 a plate-like projection 29 protrudes in direction to the upper edge 19 of the base plate 11 in a rectangular angle. To this projection 29 as well a receiver opening 30 adapted in cross-section is associated in each abutment 22, 22'. At the side facing the rear side 13 of the base plate 11 each projection 29 has a retaining surface 31 extending approximately parallel to the rear side 13, which has an undercut 32 at the transition to the stand 28. On their sides facing the projections 25 or 29 the stands 24 and 28 each have a stop surface 33 or 34 for the abutments 23, 23' or 22, 22'. The distance a (See FIG. 6) between the stop surfaces 33, 34 parallel to the plane of symmetry 18 is approximately equal to the distance a' (See FIG. 3) between the abutments 22, 23 or 22', 23' also parallel to the plane of symmetry 18. As shown in FIG. 6, the extension b from the projections 25 to the stop surface 33 parallel to the plane of symmetry 18 is slightly larger than the corresponding extension c of the projections 29.

Figure 4:
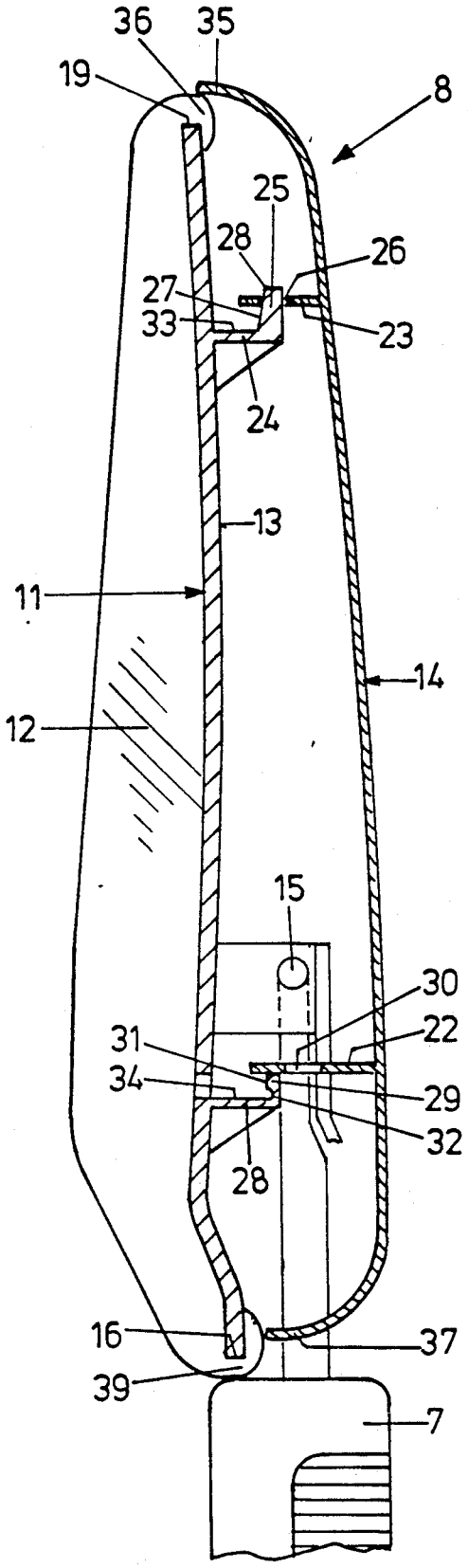
FIG. 4 shows a cross section through the back rest according to the line IV-VI in FIG. 2 in a position in which the concealing shell and the base plate face each other at the beginning of the assembly.
Figure 5:
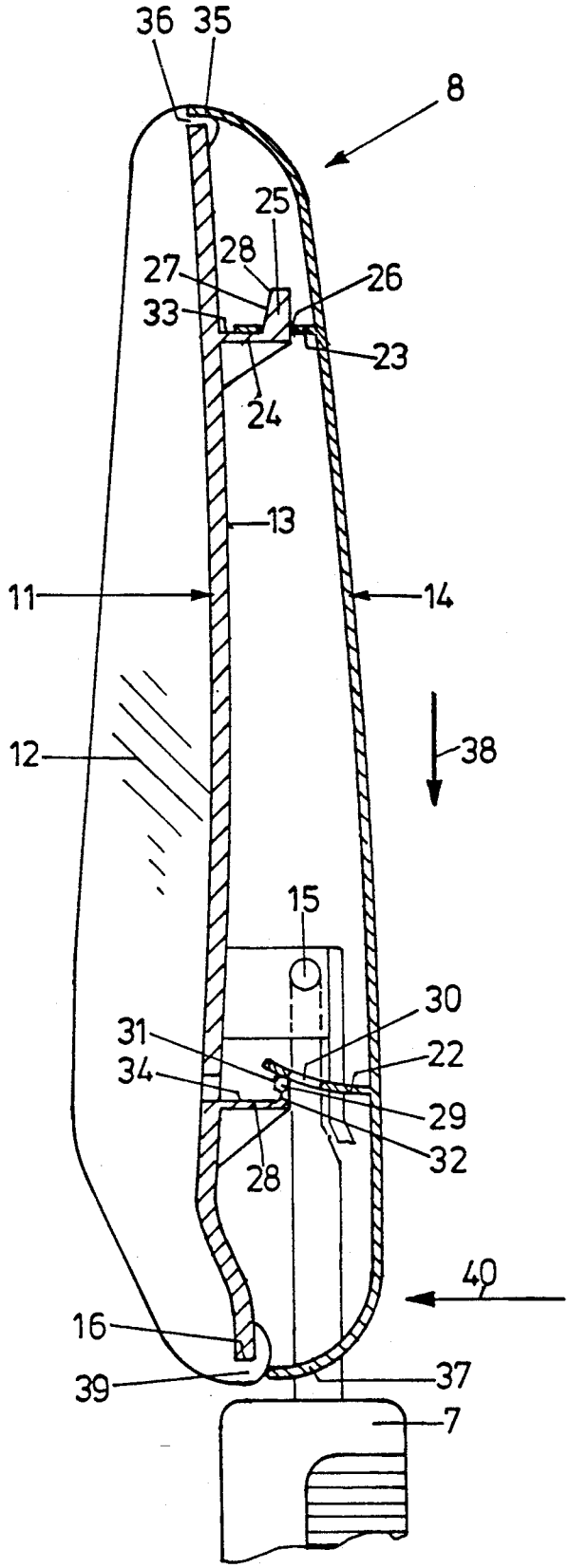
FIG. 5 shows a section through the back rest according to FIG. 4 during the assembly.

The assembly of a concealing shell 14 to the base plate 11 is shown in FIGS. 4 to 6. As can be seen from FIG. 4, the shell 14 is placed on the rear side 13 of the base plate 11, namely it is staggered towards the upper edge 19 such that the abutments 23, 23' with their receiver openings 26 arrive before the projections 25 respectively associated. The concealing shell 14 is then slightly displaced towards the lower edge 16 of the base plate 11, so that the projections 25 slightly enter the respective receiver opening 26, as can be seen from FIG. 4, and that until the abutment 22 or 22' rests before the respective projection 29 of the locking hook 17 or 17'. The upper rim 35 of the concealing shell 14 facing the upper edge 19 abuts now on the padding strip 36 embracing the upper edge 19, and that approximately flush with the rear side 13 of the base plate 11. The lower rim 37 of the concealing shell 14, however, is located at a distance from the rear side 13 of the base plate 11. Now, as shown in FIG. 5, the concealing shell 14 is displaced in relation to the base plate 11 in the direction of its lower edge 16, and that corresponding to the arrow for the direction of displacement 38. In this case the abutment 23, 23' slides on the guide surface 27 in direction to the stand 24 until it rests against its stop surface 33. The upper rim 35 of the concealing shell 14 is thus also displaced towards the base plate 11, namely it overlaps the upper edge 19 of the base plate 11. The padding strip 36 is deformed in this case, as can be seen from FIG. 5.

With this displacement according to the arrow for the direction of displacement 38 the projection 29 abuts on the respective abutment 22 or 22' so that the abutment 22 or 22'—as can be seen from FIG. 5—is bent counter to the arrow for the direction of displacement 38. The lower rim 37 of the concealing shell 14 comes in contact with the padding strip 39 of the padding 12 embracing the lower edge 16. It is, however, still at a distance to the lower edge 16. Then the lower rim 37 is pressed towards the base plate 11 according to the arrow for the exertion of pressure 40, as a result of which the receiver opening 30 of the abutment 22 or 22' is placed above the projection 29 and accordingly the projection 29 enters the receiver opening 30, and that while elastically detensioning the respective abutment 22 or 22'. By means of that the concealing shell 14 arrives its casing position shown in FIG. 6, in which also its lower rim 37 deforming the associated padding strip 39 conceals the lower edge 16 of the base plate 11. Naturally the lateral edges 41 of the base plate 11 are concealed by the lateral rims 42 of the concealing shell 14 in like manner.

In order to dismantle the concealing shell 14, it is—as can be seen from FIG. 7—slightly pressed in the region of its lower rim 37—according to the arrow for the exertion of pressure 43—towards the rear side 13 of the base plate 11, so that the abutment 22 or 22' comes out of contact with the undercut 32 of the respective projection 29. At the same time a higher pressure is exerted in direction to the upper edge 19 according to the arrow for the direction of pressure 44 onto the lower rim 37 of the shell 14, so that the lower rim 37 embracing the lower edge 16 is elastically deformed counter to the arrow for the direction of pressure 44. This displacing movement is executed until the receiver opening 30 of the abutment 22 or 22' comes out of contact with the projection 29, as can be seen from FIG. 7. Then the region of the lower rim 37 of the shell 14 can be lifted from the base plate 11 counter to the arrow for the exertion of pressure 43, and subsequently the concealing shell 14 can be displaced towards the upper edge 19 until also the abutments 23, 23' come out of contact with the projection 25 of the retaining hooks 20 or 20'.

It is also possible to carry out assembly and dismantling in the reverse direction, i.e. to assemble the concealing shell 14 in relation to the base plate 11—according to the drawing—from the lower part to the upper part and to dismantle correspondingly from the upper part to the lower part, i.e. while elastically deforming the upper rim 35. In this case also the locking hooks 17, 17' would be disposed in the region of the upper edge 19 and the retaining hooks 20, 20' in the region of the lower edge 16.

As can be seen from the aforementioned, at least the upper rim 35 and the lower rim 37 of the concealing shell 14 are also components of the elastic interlocking system, because these rims 35, 37 also contribute to the fact that the concealing shell 14 in the locked position cannot inadvertently be released from the base plate 11 without applying directed force from outside.

Figure 3:
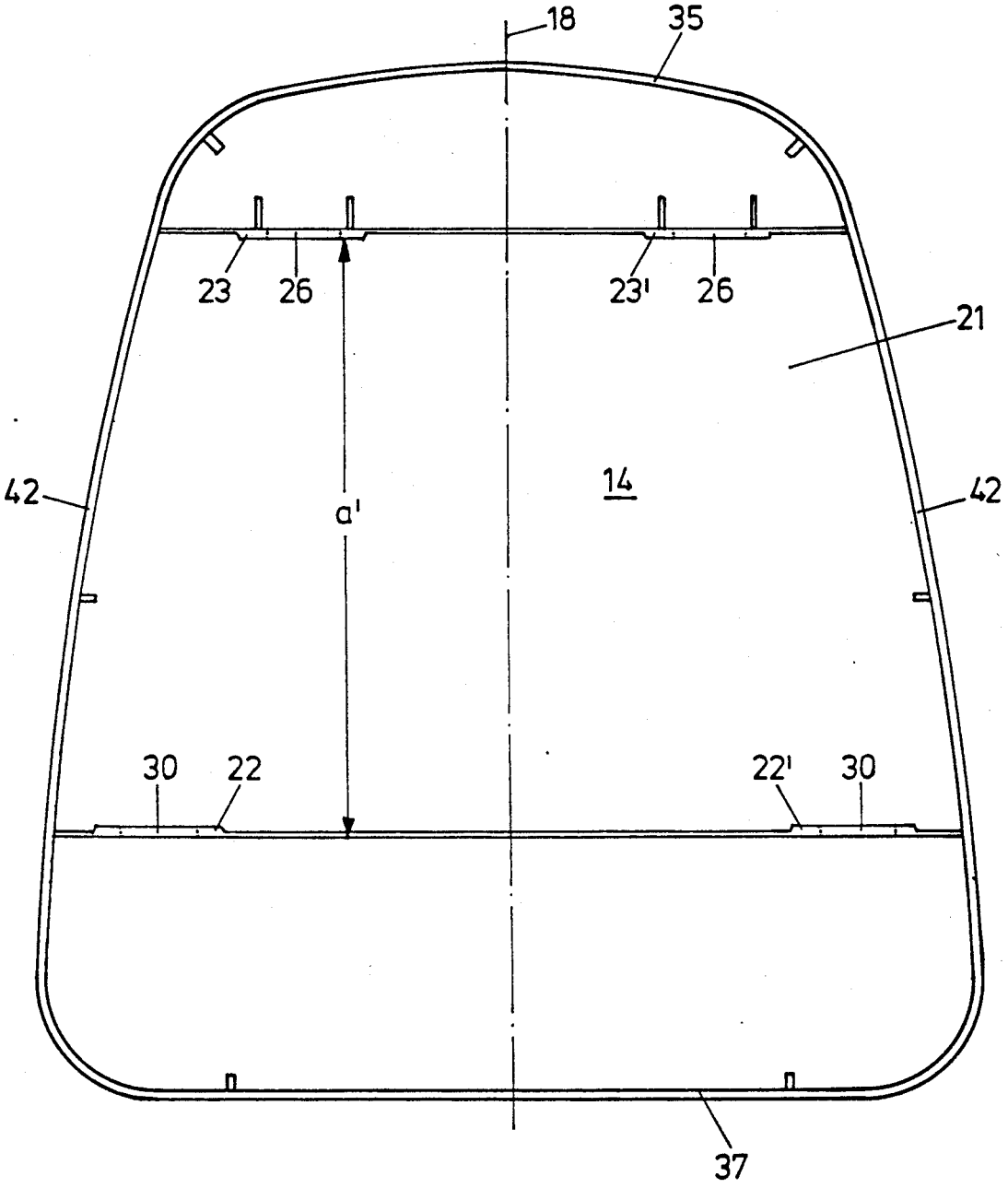
FIG. 3 shows a plan view of the inner side of a concealing shell of the back rest.

However, because of the upward tapering of the back rest 8 as can be seen from FIGS. 1, 2, 3 the described example of embodiment is the most favorable.

What is claimed is:

1. A back rest for a chair, in particular an office chair, comprising a base plate (11) having a rear side and edges (16, 19, 41); and a concealing shell (14) having rims (35, 37, 42), the concealing shell (14) being disposed at the rear side of the base plate (11), and concealing with said rims (35, 37, 42) the base plate (11) in an area of said edges (16, 19, 41), wherein the base plate (11) and the concealing shell (14) each are provided with connecting elements, which are engageable with each other and a pair of which forms a hook connection, which hook connection is lockable or releasable by displacing the base plate (11) and the concealing shell (14) in relation to each other and in a direction of displacement (38) substantially parallel to each other wherein the base plate (11) is provided with a padding (12), which embraces said edges (16, 19, 41) of the base plate (11) with padding strips (36, 39).

2. A back rest according to claim 1, wherein at least two hook connections are provided, which are disposed in relation to each other in the direction of displacement (38) and which are disposed at a distance (a, a') from each other.

3. A back rest for a chair, in particular an office chair, comprising a base plate (11) having a rear side and edges (16, 19, 41): and a concealing shell (14) having rims (35, 37, 42), the concealing shell (14) being disposed at the rear side of the base plate (11), and concealing with said rims (35, 37, 42) the base plate (11) in an area of said edges (16, 19, 41), wherein the base plate (11) and the concealing shell (14) each are provided with connecting elements, which are engageable with each other and a pair of which forms a hook connection, which hook connection is lockable or releasable by displacing the base plate (11) and the concealing shell (14) in relation to each other and in a direction of displacement (38) substantially parallel to each other, wherein each hook connection comprises a hook (17, 17', 20, 20') and an abutment (22, 22', 23, 23') as connection elements, one of said connection elements being disposed at the base plate (11) another one of said connection elements being disposed at the concealing shell (14) and wherein each hook (17, 17', 20, 20') has a stand (28, 24) with a projection (29, 25) and wherein each abutment (22, 22', 23, 23') has a receiver opening (30, 26) to receive said projection (29, 25) while displacing the base plate (11) and the concealing shell (14) in relation to each other and in the direction of displacement (38)

wherein the base plate (11) is provided with a padding (12), which embraces said edges (16, 19, 41) of the base plate (11) with padding strips (36, 39).

4. A back rest according to claim 3, wherein at least one hook is formed as a locking hook (17, 17').

5. A back rest according to claim 3, wherein at least one hook is formed as a retaining hook (20, 20').

6. A back rest according to claim 4, wherein the locking hook (17, 17') has a stand (28) with a projection (29), wherein each abutment (22, 22') has a receiver opening (30) to receive said projection (29), and wherein the locking hook (17, 17') has an undercut (32) to receive the abutment (22, 22') at a retaining surface (31), facing the base plate (11), of the projection (29).

7. A back rest according to claim 5, wherein each retaining hook (20, 20') has a stand (24) with a projection (25), wherein each abutment (23, 23') has a receiver opening (26) to receive said projection (25) and wherein said projection (25) of said retaining hook (20, 20') has a guide surface (27) extending in an inclined manner towards the base plate (11).

8. A back rest according to claim 3, wherein an extension (b) of the projection (25) of the retaining hook (20, 20') counter to the direction of displacement (38) is slightly larger than an extension (c) of the projection (29) of the locking hook (17, 17').

9. A back rest according to claim 8, wherein the abutment (22, 22') of the locking hook (17, 17') is elastically deformable counter to the direction of displacement (38).

10. A back rest according to claim 1, wherein the rims (35, 37, 42) of the concealing shell (14) abut on the padding strips (36, 39).

11. A back rest according to claim 3, wherein at least one of said rims (37), located in the direction of displacement (38), of the concealing shell (14) is elastically deformable.

12. A back rest according to claim 3, wherein the rims (35, 37, 42) of the concealing shell (14) abut on the padding strips (36, 39).

13. A back rest for a chair, in particular an office chair, comprising a base plate (11) having a rear side and edges (16, 19, 41): and a concealing shell (14) having rims (35, 37, 42), the concealing shell (14) being disposed at the rear side of the base plate (11), and concealing with said rims (35, 37, 42) the base plate (11) in an area of said edges (16, 19, 41), wherein the base plate (11) and the concealing shell (14) each are provided with connecting elements, which are engageable with each other and a pair of which forms a hook connection, which hook connection is lockable or releasable by displacing the base plate (11) and the concealing shell (14) in relation to each other and in a direction of displacement (38) substantially parallel to each other, and wherein at least one of said rims (37), located in the direction of displacement (38), of the concealing shell (14) is elastically deformable wherein the base plate (11) is provided with a padding (12), which embraces said edges (16, 19, 41) of the base plate (11) with padding strips (36, 39).

14. A back rest according to claim 13, wherein the rims (35, 37, 42) of the concealing shell (14) abut on the padding strips (36, 39).

* * * * *